US011747017B2

(12) United States Patent
Matsumura et al.

(10) Patent No.: US 11,747,017 B2
(45) Date of Patent: Sep. 5, 2023

(54) COMBUSTOR AND GAS TURBINE INCLUDING THE COMBUSTOR

(71) Applicant: Mitsubishi Hitachi Power Systems, Ltd., Yokohama (JP)

(72) Inventors: Yoshikazu Matsumura, Yokohama (JP); Naoki Abe, Yokohama (JP); Kenji Sato, Yokohama (JP); Shinji Akamatsu, Yokohama (JP); Kenta Taniguchi, Yokohama (JP); Satoshi Takiguchi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 138 days.

(21) Appl. No.: 16/628,852

(22) PCT Filed: Jul. 23, 2018

(86) PCT No.: PCT/JP2018/027423
§ 371 (c)(1),
(2) Date: Jan. 6, 2020

(87) PCT Pub. No.: WO2019/039161
PCT Pub. Date: Feb. 28, 2019

(65) Prior Publication Data

US 2020/0208575 A1 Jul. 2, 2020

(30) Foreign Application Priority Data

Aug. 21, 2017 (JP) ..... 2017-158936

(51) Int. Cl.
*F23R 3/04* (2006.01)
*F23R 3/16* (2006.01)
(Continued)

(52) U.S. Cl.
CPC ..... *F23R 3/04* (2013.01); *F23R 3/16* (2013.01); *F23R 3/286* (2013.01);
(Continued)

(58) Field of Classification Search
None
See application file for complete search history.

(56) References Cited

U.S. PATENT DOCUMENTS 6,122,916 A 9/2000 Amos et al.
2008/0184708 A1* 8/2008 Moriwaki ..... F23R 3/286 60/747
(Continued)

FOREIGN PATENT DOCUMENTS

DE 69804022 T2 8/2002
DE 112015002441 T5 3/2017
(Continued)

OTHER PUBLICATIONS

Office Action dated Jun. 18, 2020, issued in counterpart CN Application No. 201880033351.9, with English Translation. (15 pages).
(Continued)

*Primary Examiner* — Gerald L Sung
*Assistant Examiner* — Alyson Joan Harrington
(74) *Attorney, Agent, or Firm* — WHDA, LLP

(57) ABSTRACT

The upstream-side wall portion 54 includes, in the circumferential direction thereof, a first region 31 where air inlets 30 are formed at a lower density, and a second region 32 which is disposed at a position offset from the first region 31 in the circumferential direction, and in which the air inlets 30 are formed at a higher density than in the first region 31.

13 Claims, 12 Drawing Sheets

(51) Int. Cl.

| | |
|---|---|
| ***F23R 3/28*** | (2006.01) |
| *F23R 3/34* | (2006.01) |
| *F23R 3/10* | (2006.01) |
| *F23R 3/18* | (2006.01) |

(52) U.S. Cl.

CPC ..... *F05D 2270/082* (2013.01); *F23R 3/10* (2013.01); *F23R 3/18* (2013.01); *F23R 3/343* (2013.01); *F23R 2900/03041* (2013.01); *F23R 2900/03042* (2013.01)

(56) References Cited

U.S. PATENT DOCUMENTS

| | | | | |
|---|---|---|---|---|
| 2010/0319351 | A1* | 12/2010 | Inoue ..... | F23R 3/286 60/748 |
| 2017/0122563 | A1 | 5/2017 | Tanaka et al. | |
| 2017/0307219 | A1 | 10/2017 | Tsunoda et al. | |

FOREIGN PATENT DOCUMENTS

| | | | |
|---|---|---|---|
| JP | 2001-153362 | A | 6/2001 |
| JP | 2003-130351 | A | 5/2003 |
| JP | 2003-517553 | A | 5/2003 |
| JP | 2004-101071 | A | 4/2004 |
| JP | 2013-190196 | A | 9/2013 |
| KR | 10-2016-0131053 | A | 11/2016 |
| WO | 9935441 | A1 | 7/1999 |
| WO | 2015/178149 | A1 | 11/2015 |
| WO | 2016/056521 | A1 | 4/2020 |

OTHER PUBLICATIONS

Office Action dated Aug. 20, 2020, issued in counterpart KR application No. 10-2019-7034524, with English translation. (11 pages).

Notification of Transmittal of Translation of the International Preliminary Report on Patentability (Form PCT/IB/338) issued in counterpart International application No. PCT/JP2018/027423 dated Mar. 5, 2020 with Forms PCT/IB/373 and PCT/ISA/237, with English translation. (14 pages).

International Search Report dated Oct. 2, 2018, issued in counterpart application No. PCT/JP2018/027423, with English translation. (18 pages).

The Office Action dated Apr. 16, 2021, issued in counterpart DE application No. 11 2018 002 982.4. (6 pages).

The Office Action dated Apr. 20, 2021, issued in counterpart JP application No. 2017-158936, with English Translation. (10 pages).

* cited by examiner

COMBUSTOR AND GAS TURBINE INCLUDING THE COMBUSTOR

TECHNICAL FIELD

The present disclosure relates to a combustor and a gas turbine including the combustor.

BACKGROUND ART

A combustor used for a gas turbine includes a plurality of nozzles disposed in the circumferential direction to form a pre-mixed flame. To stabilize the pre-mixed flame, a flame holding ring is disposed at the radially inner side of the outlet portions of the plurality of nozzles, extending in the circumferential direction (see Patent Document 1, for instance).

CITATION LIST

Patent Literature

Patent Document 1: WO2015/178149A

SUMMARY

Problems to be Solved

However, as a result of intensive researches conducted by the present inventors, it was found that, in a case where the flame holding effect of the flame holding ring is uniform, combustion occurs before pre-mixing progresses sufficiently at a relatively upstream position near the flame holding ring, which may increase the temperature locally and increase NOx.

In view of the above, an object of at least one embodiment of the present invention is to provide a combustor and a gas turbine including the combustor, whereby it is possible to suppress local flame temperature rise and reduce the generation amount of NOx while holding the flame.

Solution to the Problems (1) According to at least one embodiment, a combustor includes: a plurality of nozzles disposed in a circumferential direction; a flame holding ring extending in the circumferential direction at a radially inner side of outlet portions of the plurality of nozzles; and an upstream-side wall portion extending in the circumferential direction at an upstream side of the flame holding ring, the upstream-side wall portion having a plurality of air inlets for supplying air toward the flame holding ring via an annular space at the radially inner side of the outlet portions of the plurality of nozzles. The upstream-side wall portion includes: a first region; and a second region which is disposed at a position offset from the first region in the circumferential direction, and in which the air inlets are formed at a higher density than in the first region.

With the above configuration (1), the second region is disposed on the upstream-side wall portion positioned upstream of the flame holding ring, and the air inlets are formed at a relatively higher density in the second region compared to the first region. Thus, the flow rate of air supplied toward the flame holding ring via the air inlets of the upstream-side wall portion has a distribution in the circumferential direction. Thus, while the flame is held in the low flow-velocity region at the downstream side of the flame holding ring in the circumferential-directional region corresponding to the first region, in the circumferential-directional region corresponding to the second region, flame holding is impaired by the flow of air supplied from the upstream-side wall portion, and thereby the flame holding effect of the flame holding ring becomes uneven in the circumferential direction. Thus, it is possible to suppress combustion at the upstream side where pre-mixing is insufficient at least in a partial region in the circumferential direction, and suppress an increase in the generation amount of NOx due to local flame temperature rise effectively, while holding the flame.

(2) In some embodiments, in the above configuration (1), the flame holding ring includes a first opening positioned at a downstream side of the second region.

With the above configuration (2), the first opening is disposed on the flame holding ring so as to be positioned downstream of the second region of the upstream-side wall portion, and thereby a relatively high rate of air from the second region of the upstream-side wall portion is guided to the downstream side of the flame holding ring via the first opening of the flame holding ring. Thus, in the circumferential-directional region with the first opening of the flame holding ring, it is possible to impair flame holding by the flame holding ring effectively, and obtain an uneven distribution for the flame holding effect of the flame holding ring in the circumferential direction easily. Thus, it is possible to suppress combustion at the upstream side where pre-mixing is insufficient even further, and suppress an increase in the generation amount of NOx due to local flame temperature rise effectively, while holding the flame.

(3) In some embodiments, in the above configuration (2), the first opening includes at least one cut-out which is cut out from an outer peripheral edge of the flame holding ring to a position at a radially outer side of an inner peripheral edge of the flame holding ring, toward an inner side of the flame holding ring in a radial direction.

With the above configuration (3), the cut-out has a smaller opening area than an opening which is cut out from the outer peripheral edge to the inner peripheral edge of the flame holding ring, and thus it is possible to suppress the flow rate of air flowing through the cut-out. When the air passing through the cut-out has a high flow rate, the volume of air used in combustion decreases, and the generation amount of NOx increases. In the above configuration (3), by suppressing the flow rate of air flowing through the cut-out, it is possible to suppress an increase in the generation amount of NOx.

(4) In some embodiments, in the above configuration (3), the cut-out has a maximum cut-out depth which is not greater than ⅔ of a distance between the outer peripheral edge and the inner peripheral edge in the radial direction of the flame holding ring.

With the above configuration (4), the flow rate of air flowing through the cut-out is suppressed compared to a cut-out that is cut out from the outer peripheral edge to the inner peripheral edge, and thus it is possible to suppress an increase in the generation amount of NOx.

(5) In some embodiments, in the above configuration (2), the first opening includes at least one through hole formed between an outer peripheral edge of the flame holding ring and an inner peripheral edge of the flame holding ring.

With the above configuration (5), the through hole has a smaller opening area than an opening which is cut out from the outer peripheral edge to the inner peripheral edge of the flame holding ring, and thus it is possible to suppress the flow rate of air that flows through the through hole. If the air passing through the through hole has a high flow rate, the volume of air used in combustion decreases, and the density of fuel in the premixed gas increases. In the above configuration (5), by suppressing the flow rate of air that flows through the through hole, it is possible to suppress an increase in the generation amount of NOx.

(6) In some embodiments, in any one of the above configurations (1) to (5), an extension range of the second region in the circumferential direction includes a circumferential-directional position between a pair of the nozzles which are adjacent in the circumferential direction, and an extension range of the first region in the circumferential direction includes a circumferential-directional position corresponding to a position of at least one of the nozzles.

With the above configuration (6), the flow rate of air supplied from the circumferential-directional position between the nozzles is higher than the flow rate of air supplied from the circumferential-directional position corresponding to the position of the nozzle, and flame holding is impaired downstream of the circumferential-directional position between the nozzles. In the region downstream of the gap between the nozzles, the mixing state of the premixed gas is relatively insufficient. Thus, when flame is held in this region, the generation amount of NOx is likely to increase due to local flame temperature rise. Thus, by impairing flame holding in this region, it is possible to suppress an increase in the generation amount of NOx.

(7) In some embodiments, in any one of the above configurations (1) to (6), the combustor further includes at least one partition member extending along an axial direction in the annular space between the upstream-side wall portion and the flame holding ring, the at least one partition member dividing the annular space into a first space corresponding to the first region and a second space corresponding to the second region.

With the above configuration (7), the partition member suppresses a decrease of the air amount inside the second space by preventing the air from flowing into the first space from the second space. Accordingly, the distribution of the air flow rate in the circumferential direction is maintained, and thereby it is possible to maintain the flame holding effect of the flame holding ring to be uneven in the circumferential direction.

(8) In some embodiments, in any one of the above configurations (1) to (7), the combustor further includes: a pilot cone having the flame holding ring at a downstream end; and a cooling ring disposed at a radially outer side of the pilot cone and at the radially inner side of the outlet portions of the plurality of nozzles. A gap is formed between the pilot cone and the cooling ring.

With the above configuration (8), air flows through the gap between the pilot cone and the cooling ring, and thereby it is possible to cool the pilot cone and the flame holding ring.

(9) In some embodiments, in the above configuration (8), the flame holding ring includes a first opening positioned at a downstream side of the second region, and the air inlets of the upstream-side wall portion and the first opening of the flame holding ring are in communication via a space at a radially outer side of the cooling ring and at the radially inner side of the outlet portions of the nozzles.

With the above configuration (9), the first opening is disposed on the flame holding ring so as to be positioned downstream of the second region of the upstream-side wall portion, and the air inlets of the upstream-side wall portion and the first opening of the flame holding ring are in communication via the space at the radially outer side of the cooling ring and at the radially inner side of the outlet portions of the plurality of nozzles. Thus, a relatively high rate of air from the second region of the upstream-side wall portion is guided to the downstream side of the flame holding ring via the first opening of the flame holding ring. Thus, in the circumferential-directional region with the first opening of the flame holding ring, it is possible to impair flame holding by the flame holding ring effectively, and obtain an uneven distribution for the flame holding effect of the flame holding ring in the circumferential direction easily. Thus, it is possible to suppress combustion at the upstream side of the flame holding ring where pre-mixing is insufficient even further, and suppress an increase in the generation amount of NOx due to local flame temperature rise effectively, while holding the flame.

(10) In some embodiments, in the above configuration (8) or (9), the upstream-side wall portion has a cooling air inlet which opens into the gap between the pilot cone and the cooling ring.

With the above configuration (10), air having passed through the cooling air inlet flows through the gap between the pilot cone and the cooling ring, and thereby it is possible to cool the pilot cone and the flame holding ring.

(11) In some embodiments, in any one of the above configurations (8) to (10), the flame holding ring positioned at the downstream end of the pilot cone includes a first opening positioned at a downstream side of the second region, the cooling ring includes a flange portion positioned at an upstream side of the flame holding ring, and the flange portion includes a second opening corresponding to the first opening of the flame holding ring.

With the above configuration (11), the first opening is disposed on the flame holding ring so as to be positioned downstream of the second region of the upstream-side wall portion, and the second opening is disposed on the flange portion of the cooling ring so as to correspond to the first opening of the flame holding ring. Thus, a relatively high flow rate of air from the second region of the upstream-side wall portion is guided to the downstream side of the flame holding ring via the first opening on the flame holding ring and the second opening on the flange portion. Thus, in the circumferential-directional region where the first opening of the flame holding ring is disposed, it is possible to impair flame holding by the flame holding ring effectively, and obtain an uneven distribution for the flame holding effect of the flame holding ring in the circumferential direction easily. Thus, it is possible to suppress combustion at the upstream side where pre-mixing is insufficient even further, and suppress an increase in the generation amount of NOx due to local flame temperature rise effectively, while holding the flame.

(12) In some embodiments, in any one of the above configurations (8) to (11), the combustor includes at least one spacer portion for forming the gap between the pilot cone and the cooling ring.

With the above configuration (12), it is possible to form a gap between the pilot cone and the cooling ring easily and reliably. With air flowing through this gap, it is possible to cool the pilot cone and the flame holding ring.

(13) In some embodiments, in the above configuration (12), the cooling ring includes a flange portion positioned at an upstream side of the flame holding ring, the flange portion has a second opening corresponding to the first opening of the flame holding ring, the at least one spacer portion includes a plurality of protruding portions disposed on the flange portion so as to protrude downstream toward the flame holding ring, and the plurality of protruding portions include a pair of protruding portions positioned at either side of each second opening of the flange portion in the circumferential direction.

With the above configuration (13), it is possible to form a uniform gap in the circumferential direction between the flame holding ring and the flange portion, and thus it is possible to cool the pilot cone and the flame holding ring uniformly.

(14) According to at least one embodiment of the present invention, a combustor includes: a plurality of nozzles disposed in a circumferential direction; and a flame holding ring extending in the circumferential direction at a radially inner side of outlet portions of the plurality of nozzles. The flame holding ring has a plurality of cut-outs formed on an outer peripheral edge portion of the flame holding ring, each of the plurality of cut-outs being disposed at a circumferential-directional position between a pair of the nozzles which are adjacent in the circumferential direction, each of the cut-outs of the flame holding ring has a greater width than a downstream-side end portion of a partition wall disposed on the outlet portions between the pair of adjacent nozzles in the circumferential direction, and each of the cut-outs of the flame holding ring has, in a radial direction, a cut-out depth which is smaller at opposite end portions of the cut-out in the circumferential direction than at a center portion of the cut-out in the circumferential direction.

With the above configuration (14), while the flame holding performance is low or the flame is not held at all at the portion where the cut-out is formed at the circumferential-directional position between a pair of nozzles that are adjacent in the circumferential direction, the flame is held at the portion where the cut-out is not formed or the cut-out depth of the cut-out is small. Thus, it is possible to obtain an uneven distribution for the flame holding effect of the flame holding ring in the circumferential direction easily. Thus, it is possible to suppress combustion at the upstream side where pre-mixing is insufficient, and suppress an increase in the generation amount of NOx due to local flame temperature rise, while holding the flame.

Furthermore, with the above configuration (14), the cut-out has a greater width than the downstream-side end portion of the partition wall, and thus flame holding is impaired in the region downstream of the downstream-side end portion of the partition wall. In the region downstream of the downstream-side end portion of the partition wall, the mixing state of the pre-mixed gas is relatively insufficient. Thus, when the flame is held in the former region, the generation amount of NOx is likely to increase due to local flame temperature rise. Thus, by impairing flame holding in the former region, it is possible to suppress an increase in the generation amount of NOx.

Furthermore, with the above configuration (14), the cut-out depth of the cut-out in the radial direction is smaller at the opposite end portions of the cut-out in the circumferential direction than at the center portion of the cut-out in the circumferential direction, and thus the flame holding performance decreases from the opposite end portions toward the center portion of the cut-out with respect to the circumferential direction. Accordingly, it is possible to impair flame holding reliably in the region downstream of the circumferential-directional position corresponding to the partition wall.

(15) In some embodiments, in the above configuration (14), the cut-out depth of the cut-outs is maximum at a circumferential-directional position of the downstream end portion of the partition wall.

With the above configuration (15), the flame holding performance reaches its minimum at the circumferential-directional position of the downstream-side end portion of the partition wall, and thus it is possible to impair flame holding reliably at the downstream side of the circumferential-directional position corresponding to the partition wall.

(16) In some embodiments, in the above configuration (14) or (15), the cut-outs are disposed at a radially outer side of an inner peripheral edge of the flame holding ring.

With the above configuration (16), the cut-out has a smaller opening area than a cut-out which is cut out from the outer peripheral edge to the inner peripheral edge of the flame holding ring, and thus it is possible to suppress the flow rate of air that flows through the cut-out. If the air passing through the cut-out has a high flow rate, the volume of air used in combustion decreases. In the above configuration (16), by suppressing the flow rate of air flowing through the cut-out, it is possible to suppress an increase in the generation amount of NOx.

(17) In some embodiments, in any one of the above configurations (14) to (16), the cut-outs each have a maximum cut-out depth which is not greater than ⅔ of a distance between the outer peripheral edge and an inner peripheral edge in a radial direction of the flame holding ring.

With the above configuration (17), the flow rate of air that flows through the cut-out is suppressed compared to a cut-out that is cut out from the outer peripheral edge to the inner peripheral edge, and thus it is possible to suppress an increase in the generation amount of NOx.

(18) In some embodiments, in any one of the above configurations (14) to (17), the combustor further includes an upstream-side wall portion extending in the circumferential direction at an upstream side of the flame holding ring, the upstream-side wall portion having a plurality of air inlets for forming an air flow which flows toward the flame holding ring via an annular space at the radially inner side of the outlet portions of the plurality of nozzles. The upstream-side wall portion includes: a first region; and a second region which is disposed at a position offset from the first region in the circumferential direction at an upstream side of the cut-outs of the flame holding ring, and in which the air inlets are formed at a higher density than in the first region.

With the above configuration (18), the second region is disposed on the upstream-side wall portion positioned upstream of the flame holding ring, and the air inlets are formed at a relatively higher density in the second region compared to the first region. Thus, the flow rate of air supplied toward the flame holding ring via the air inlets of the upstream-side wall portion has a distribution in the circumferential direction. Thus, while the flame is held in the low flow-velocity region downstream of the flame holding ring in the circumferential-directional region corresponding to the first region, in the circumferential-directional region corresponding to the second region, flame holding is impaired by the flow of air supplied from the upstream-side wall portion, and thereby the flame holding effect of the flame holding ring becomes uneven in the circumferential direction. Thus, it is possible to suppress combustion at the upstream side where pre-mixing is insufficient at least in a partial region in the circumferential direction, and suppress an increase in the generation amount of NOx due to local flame temperature rise effectively, while holding the flame.

(19) According to at least one embodiment of the present invention, a gas turbine includes: the combustor according to any one of the above (1) to (18); and a turbine configured to be driven by combustion gas from the combustor.

With the above configuration (19), it is possible to reduce the amount of NOx generated from the combustor, and thus it is possible to obtain a gas turbine capable of reducing the generation amount of NOx.

Advantageous Effects

According to at least one embodiment of the present invention, the flame holding effect of the flame holding ring is uneven in the circumferential direction, and thus it is possible to suppress combustion at the upstream side where pre-mixing is insufficient in at least a partial region in the circumferential direction while holding the flame, and suppress an increase in the generation amount of NOx due to local flame temperature rise while holding the flame.

DETAILED DESCRIPTION

Embodiments of the present invention will now be described in detail with reference to the accompanying drawings. However, the scope of the present invention is not limited to the following embodiments. It is intended that dimensions, materials, shapes, relative positions and the like of components described in the embodiments shall be interpreted as illustrative only and not intended to limit the scope of the present invention.

Figure 1:
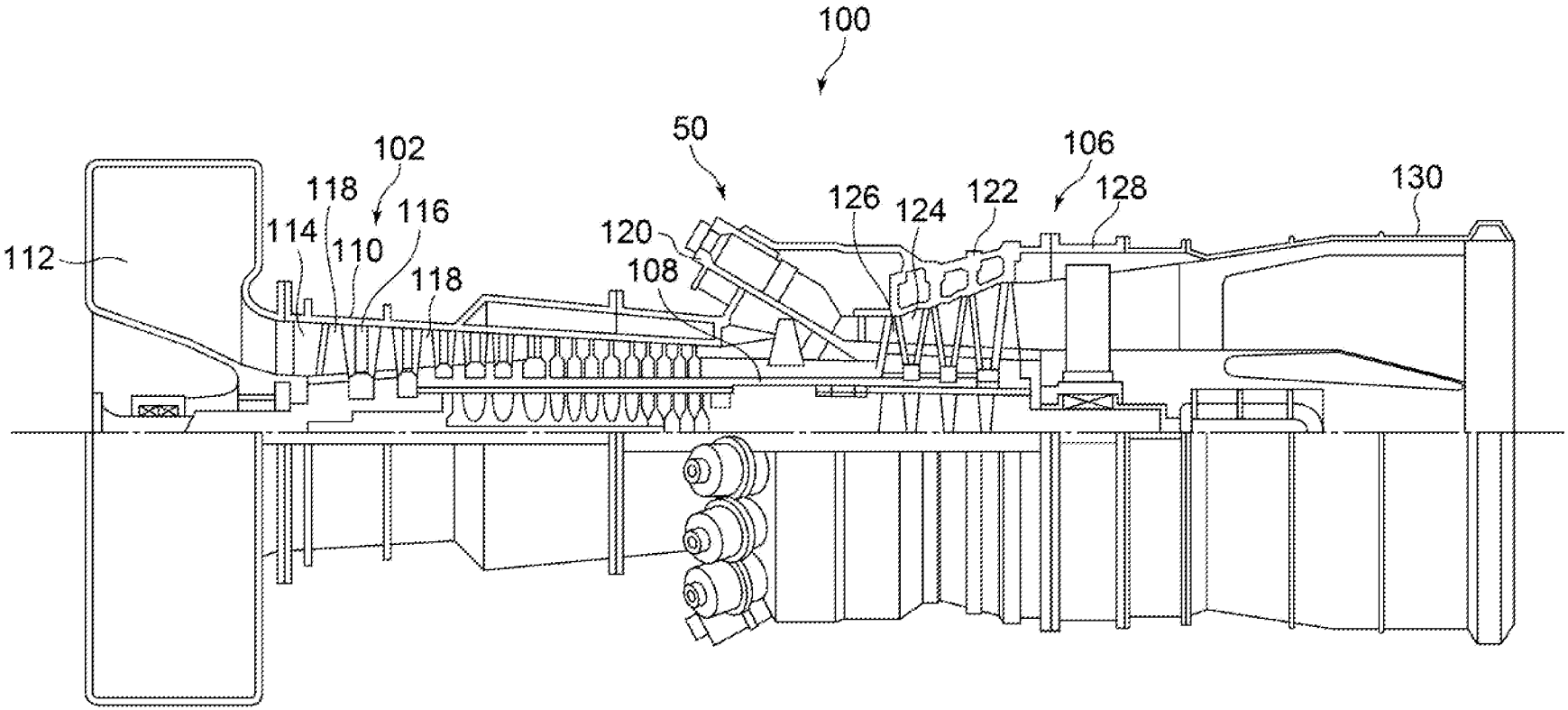
FIG. 1 is a schematic configuration diagram of a gas turbine according to an embodiment.

Firstly, with reference to FIG. 1, the configuration of a gas turbine according to an embodiment will be described.

The gas turbine 100 according to an embodiment includes a compressor 102 for producing compressed air that serves as an oxidant, a combustor 50 for producing combustion gas using the compressed air and fuel, and a turbine 106 configured to be driven by combustion gas to rotate. In the case of the gas turbine 100 for power generation, a generator (not illustrated) is connected to the turbine 106, so that rotational energy of the turbine 106 generates electric power.

The configuration example of each component in the gas turbine 100 will be described specifically.

The compressor 102 includes a compressor casing 110, an air inlet 112 for sucking in air, disposed on the inlet side of the compressor casing 110, a rotor 108 disposed so as to penetrate through both of the compressor casing 110 and the turbine casing 122 described below, and a variety of vanes disposed in the compressor casing 110. The variety of vanes includes an inlet guide vane 114 disposed adjacent to the air inlet 112, a plurality of stator vanes 116 fixed to the compressor casing 110, and a plurality of rotor vanes 118 disposed on the rotor 108 so as to be arranged alternately with the stator vanes 116. The compressor 102 may include other constituent elements not illustrated in the drawings, such as an extraction chamber. In the above compressor 102, the air sucked in from the air inlet 112 flows through the plurality of stator vanes 116 and the plurality of rotor vanes 118 to be compressed and turn into compressed air having a high temperature and a high pressure, which is then sent to the combustor 50 of the latter stage from the compressor 102.

The combustor 50 is disposed in a casing 120. A plurality of combustors 50 may be disposed in an annular shape centered at the rotor 108 inside the casing 120. The combustor 50 is supplied with fuel and the compressed air produced in the compressor 102, and combusts the fuel to produce combustion gas that serves as a working fluid of the turbine 106. The generated combustion gas is sent to the turbine 106 of the latter stage from the combustor 50.

The turbine 106 includes a turbine casing 122 and a variety of vanes disposed inside the turbine casing 122. The variety of vanes include a plurality of stator vanes 124 fixed to the turbine casing 122 and a plurality of rotor vanes 126 disposed on the rotor 108 so as to be arranged alternately with the stator vanes 124. The turbine 106 may include other constituent elements, such as outlet guide vanes and the like. In the turbine 106, the rotor 108 is rotary driven as the combustion gas passes through the plurality of stator vanes 124 and the plurality of rotor vanes 126. In this way, the generator connected to the rotor 108 is driven.

An exhaust chamber 130 is connected to the downstream side of the turbine casing 122 via an exhaust casing 128. The combustion gas having driven the turbine 106 passes through the exhaust casing 128 and the exhaust chamber 130 before being discharged outside.

Next, some embodiments of the combustor 50 will be described.

Figure 2:
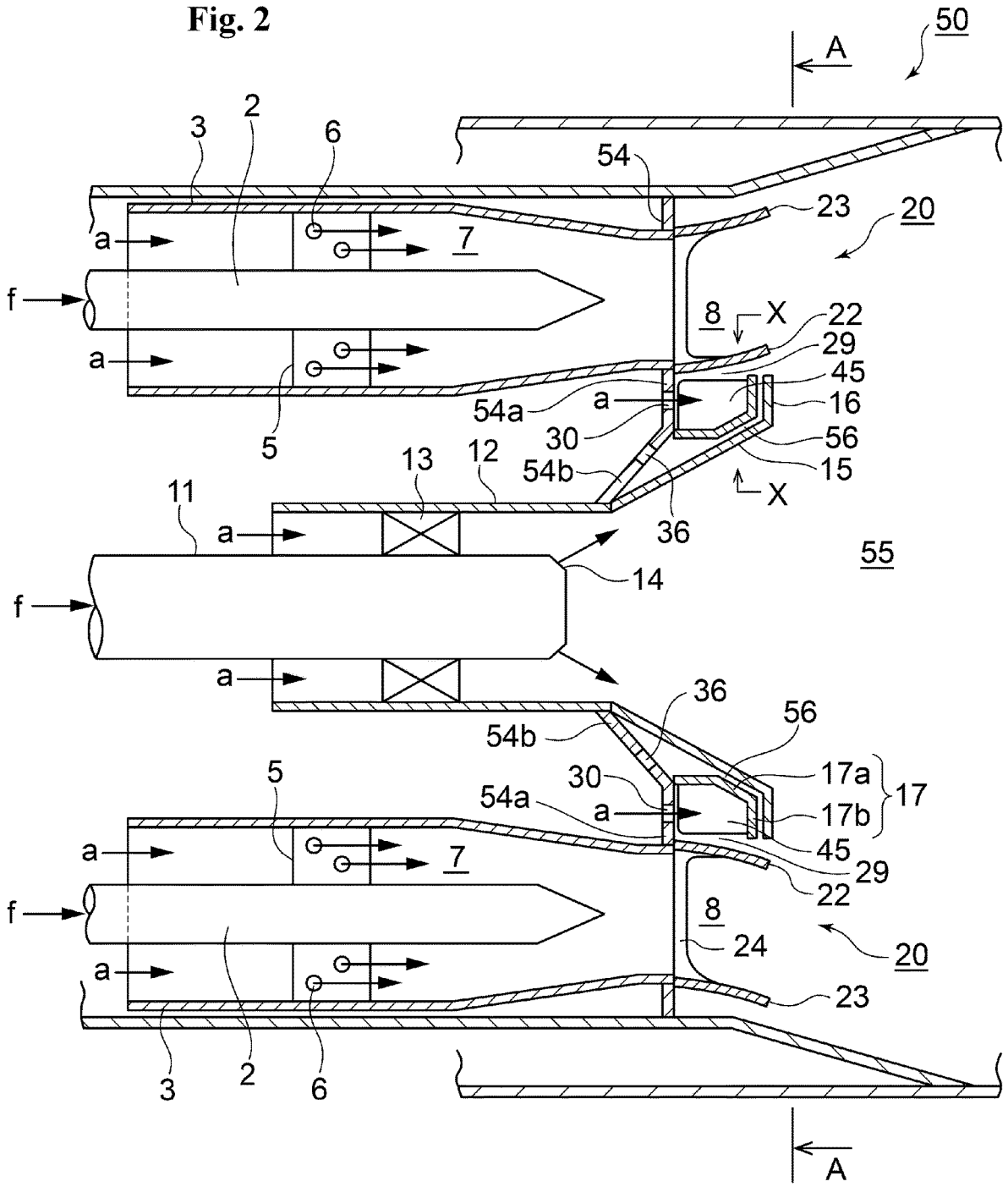
FIG. 2 is a cross-sectional view of a combustor according to an embodiment.
Figure 3:
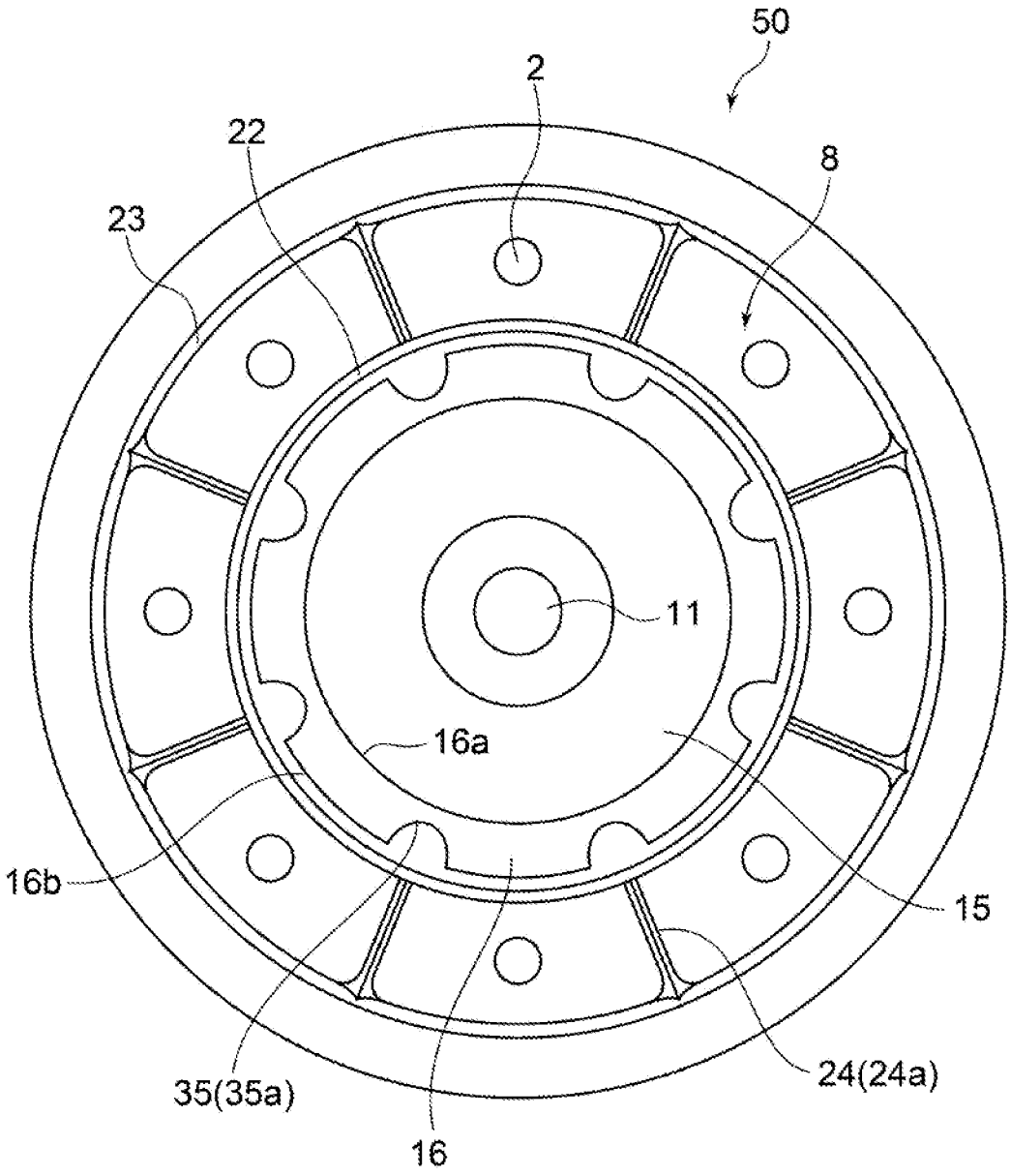
FIG. 3 is an A-A arrow view from FIG. 2.

In FIGS. 2 and 3, a combustor 50 according to an embodiment is depicted. The combustor 50 includes a plurality of first nozzles 2 arranged in the circumferential direction of the combustor 50. The first nozzles 2 are housed in a first nozzle cylinder 3. The first nozzles 2 are pre-mixed combustion nozzles, for instance. In this case, each first nozzle 2 is configured to pre-mix compressed air 'a' supplied to the internal space 7 of the first nozzle cylinder 3 and fuel 'f' supplied from the first nozzles 2 or the fuel injection hole 6 of the first swirler 5 to form a pre-mixed gas, and combusts the pre-mixed gas.

In this embodiment, the combustor 50 may further include a single second nozzle 11 disposed so as to be surrounded by the plurality of first nozzles 2. The second nozzle 11 is housed in a second nozzle cylinder 12 having a cylindrical shape. The second nozzle cylinder 12 accommodates a second swirler 13 between the second nozzle 11 and the second nozzle cylinder 12. A fuel injection hole 14 is disposed on the downstream end portion of the second nozzle 11.

The second nozzle 11 is a diffusion combustion nozzle, for instance. In this case, the second nozzle 11 is configured to perform diffusion combustion by injecting a fuel toward the combustion chamber 55 of the combustor 50 from the fuel injection hole 14 disposed on the downstream-side end portion. However, the second nozzle 11 is not limited to a diffusion combustion nozzle, and may be another type of nozzle such as a pre-mixing combustion nozzle.

In this embodiment, the outlet portions 20 of the plurality of first nozzles 2 have an inner ring 22 extending in the circumferential direction disposed on the downstream side of the plurality of first nozzle cylinders 3, and an outer ring 23 extending in the circumferential direction so as to from an annular middle flow passage 8 together with the inner ring 22, disposed on the downstream side of the plurality of first nozzle cylinders 3 and at the radially outer side of the inner ring 22. Furthermore, the middle flow passage 8 may include a partition wall 24 disposed so as to be positioned between adjacent first nozzles 2, 2. The partition wall 24 may be a stagnation suppression portion 24*a*, and the stagnation suppression portion 24*a* may have a width that decreases toward the downstream side. With the stagnation suppression portion 24*a* having a width that decreases toward the downstream side, it is possible to suppress stagnation of the flow of premixed gas that flows into the middle flow passage 8 from the internal space 7 of the first nozzle cylinders 3, at the downstream end of the first nozzle cylinders 3.

Figure 4:
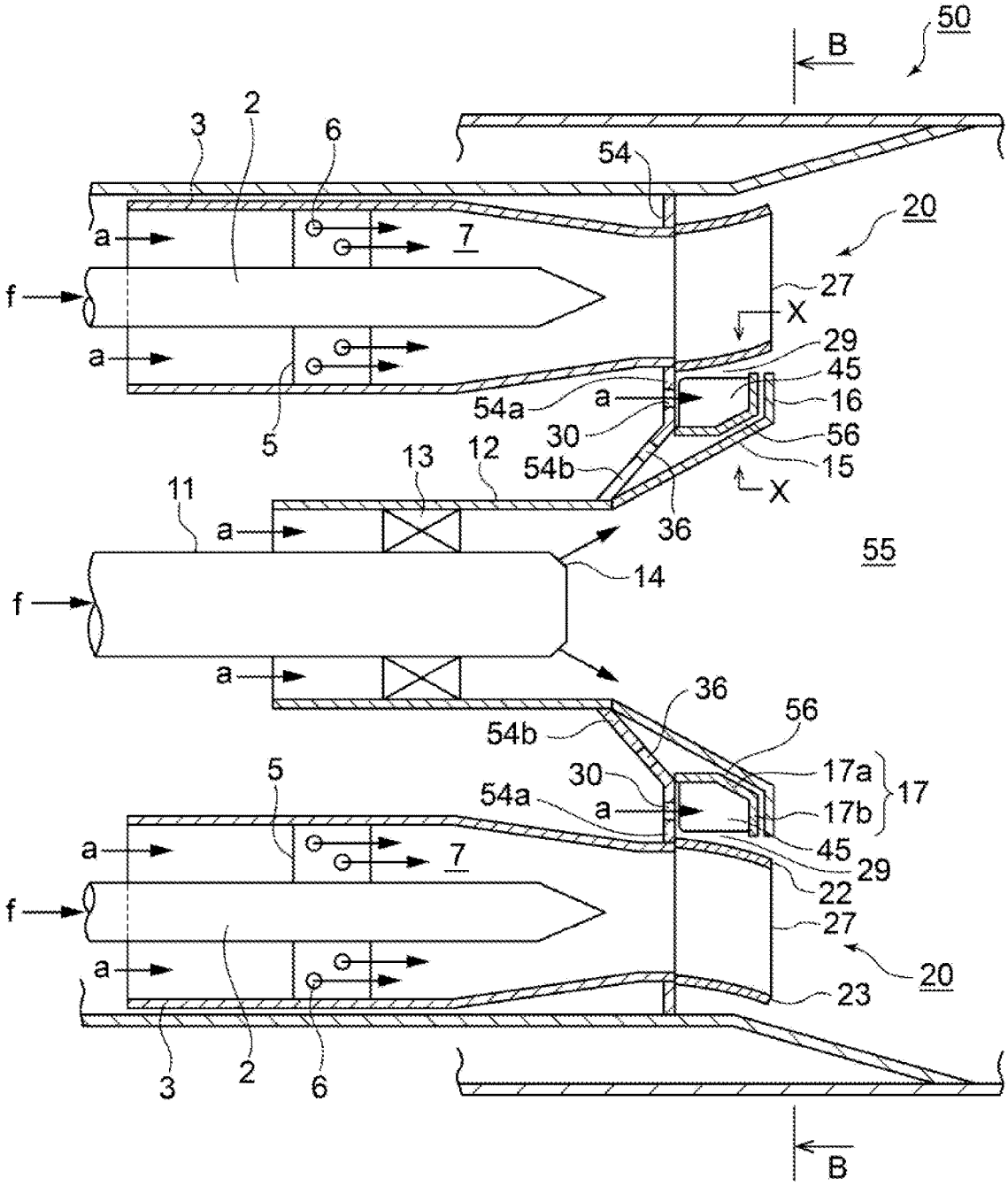
FIG. 4 is a cross-sectional view of a combustor according to another embodiment.
Figure 5:
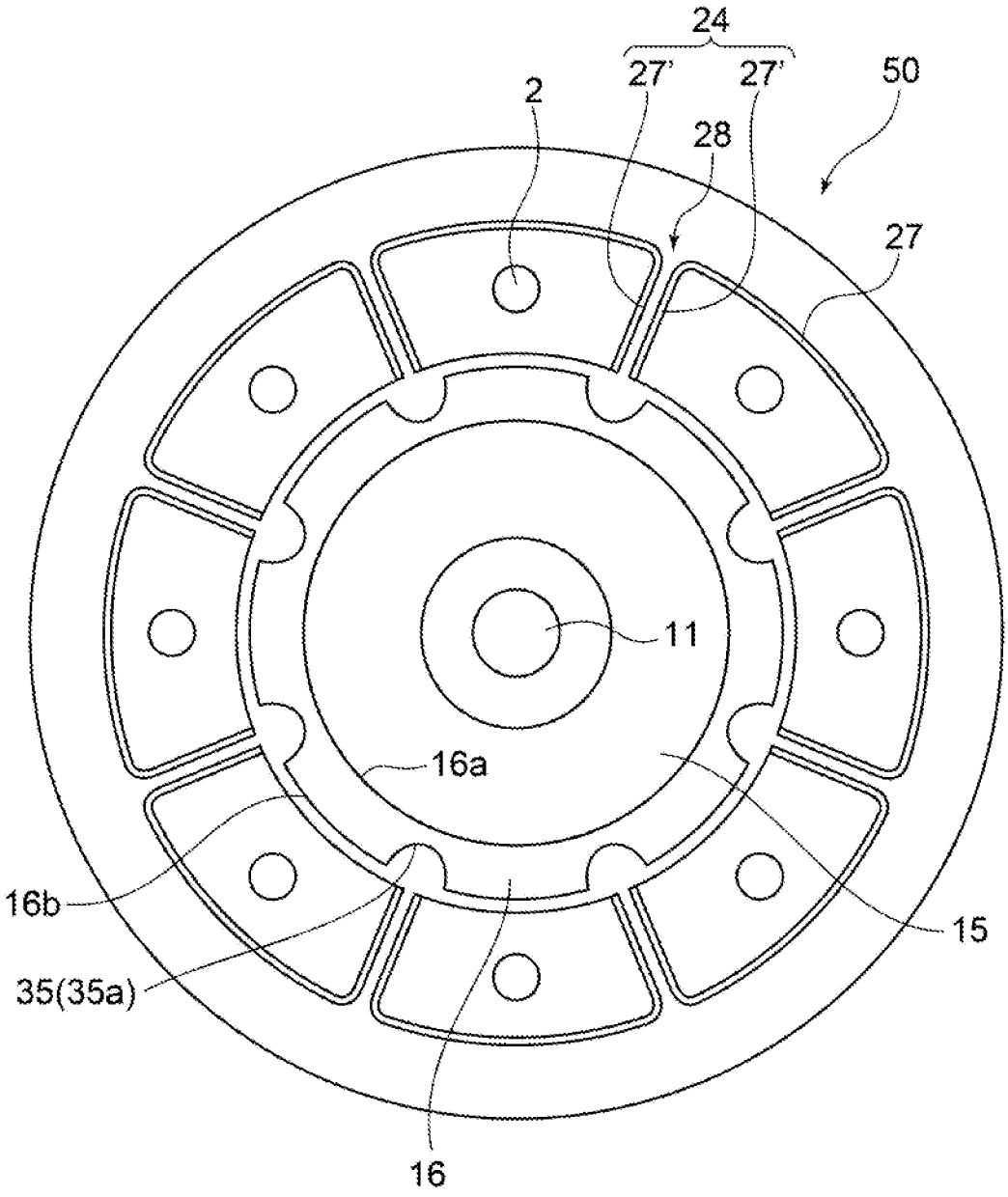
FIG. 5 is a B-B arrow view from FIG. 4.

In FIGS. 4 and 5, a combustor 50 according to another embodiment is depicted. The combustor 50 depicted in FIGS. 4 and 5 is different from the combustor 50 in FIGS. 2 and 3 only in the configuration of the outlet portions 20 of the plurality of first nozzles 2, and thus only the configuration of the outlet portions 20 of the combustor 50 depicted in FIGS. 4 and 5 will be described below.

The outlet portions 20 have an extension pipe 27 having a tubular shape and extending coaxially with the first nozzle cylinders 3, at the downstream side of the first nozzle cylinders 3. As depicted in FIG. 5, a gap 28 is formed between a pair of adjacent extension pipes 27, 27. In this embodiment, wall portions 27', 27' of a pair of adjacent extension pipes 27, 27 with the gap 28 formed therebetween form a partition wall 24 positioned between a pair of adjacent first nozzles 2, 2.

In the embodiments depicted in FIGS. 2, 3, 4, and 5, the combustor 50 includes a flame holding ring 16 extending in the circumferential direction of the combustor 50, at the radially inner side of the outlet portions 20 of the plurality of first nozzles 2. The combustor 50 may further include a pilot cone 15 having an end connected to the downstream end of the second nozzle cylinder 12 and another end connected to the flame holding ring 16. The pilot cone 15 may have a truncated cone shape whose diameter increases from the upstream end toward the downstream end. The flame holding ring 16 extends outward in the radial direction of the combustor 50 from the downstream end of the pilot cone 15. In the embodiments depicted in FIGS. 2, 3, 4, and 5, the flame holding ring 16 extends toward the outer side in the radial direction of the combustor 50 so as to be perpendicular to the longitudinal direction of the first nozzles 2. Nevertheless, the flame holding ring 16 may extend outward in the radial direction of the combustor 50 so as to form an angle with the longitudinal direction of the first nozzles 2. Furthermore, the flame holding ring 16 may extend outward in the radial direction of the combustor 50 so as to form an angle that changes in stages toward the outer side in the radial direction of the combustor 50, with the longitudinal direction of the first nozzles 2.

Figure 6:
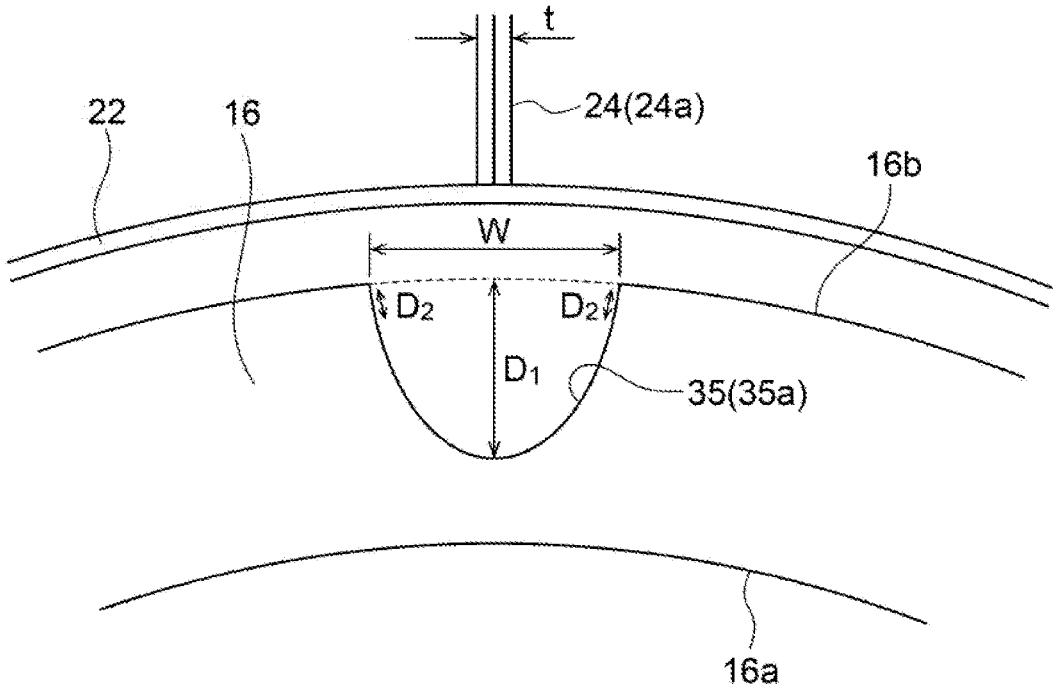
FIG. 6 is an enlarged view of the first opening formed on a flame holding ring of a combustor according to an embodiment.

As depicted in FIGS. 3 and 5, the flame holding ring 16 has first openings 35 formed thereon, such that the first openings 35 have intervals between one another in the circumferential direction of the flame holding ring 16. As depicted in FIG. 6, the first openings 35 may be formed as cut-outs 35*a* which are cut out from the outer peripheral edge 16*b* to the radially outer side of the inner peripheral edge 16*a* of the flame holding ring 16, that is, on the outer peripheral edge portion of the flame holding ring 16. Each cut-out 35*a* has a width W in the circumferential direction of the flame holding ring 16 at the outer peripheral edge 16*b*, and the width W is greater than the thickness 't' of the partition wall 24. Furthermore, with regard to the cut-out depth of the cut-outs 35*a* in the radial direction of the flame holding ring 16, the depth $D_2$ at the opposite end portions of the cut-out 35*a* in the circumferential direction of the flame holding ring 16 is smaller than the depth $D_1$ at the center portion of the cut-out 35*a* in the circumferential direction of the flame holding ring 16.

Figure 7:
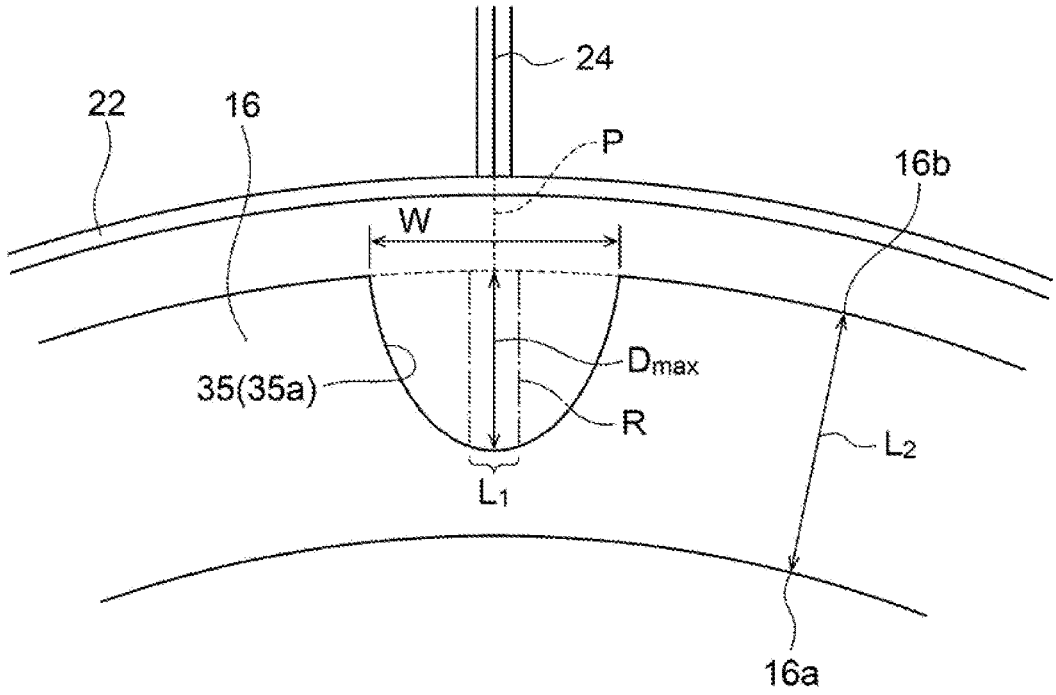
FIG. 7 is an enlarged view of the first opening formed on a flame holding ring of a combustor according to an embodiment.

As depicted in FIG. 7, the cut-out 35*a* preferably has a maximum cut-out depth $D_{max}$ at the circumferential-directional position P of the downstream-side end portion of the partition wall 24. However, this feature only applies to the embodiment in FIG. 7, and does not apply to the embodiment in FIG. 3. In FIG. 7, the circumferential-directional position P is illustrated as the center position of the downstream-side end portion of the partition wall 24 with respect to the circumferential direction. Nevertheless, the cut-out 35*a* may not necessarily have the maximum cut-out depth $D_{max}$ at the circumferential-directional position P accurately, and may have the maximum cut-out depth $D_{max}$ in a region R of the distance $L_1$ centered at the circumferential-directional position P in the circumferential direction. Herein, the distance $L_1$ preferably has a relationship $L_1 \leq 0.3$ W relative to the width W of the cut-out 35*a* of the flame holding ring in the circumferential direction at the outer peripheral edge 16*b*. Preferably, the maximum cut-out depth $D_{max}$ is not greater than ⅔ of the distance $L_2$ from the outer peripheral edge 16*b* to the inner peripheral edge 16*a* in the radial direction of the flame holding ring 16.

DETAILED DESCRIPTION

Figure 8A:
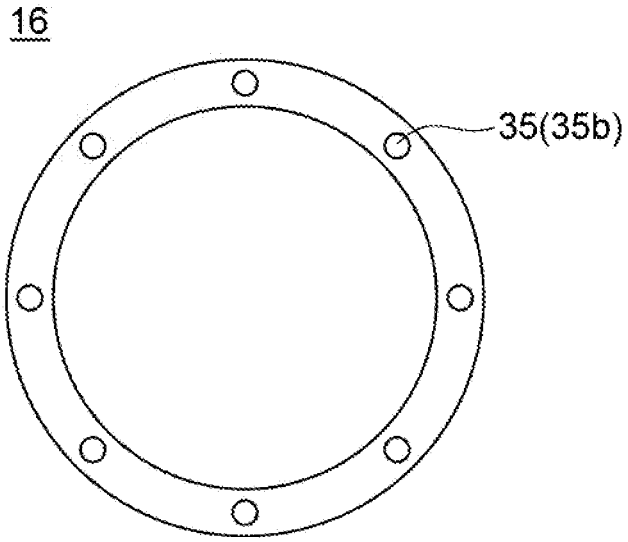
FIGS. 8A, 8B are each a planar view showing a modified example of a flame holding ring disposed on a combustor according to an embodiment.
Figure 8B:
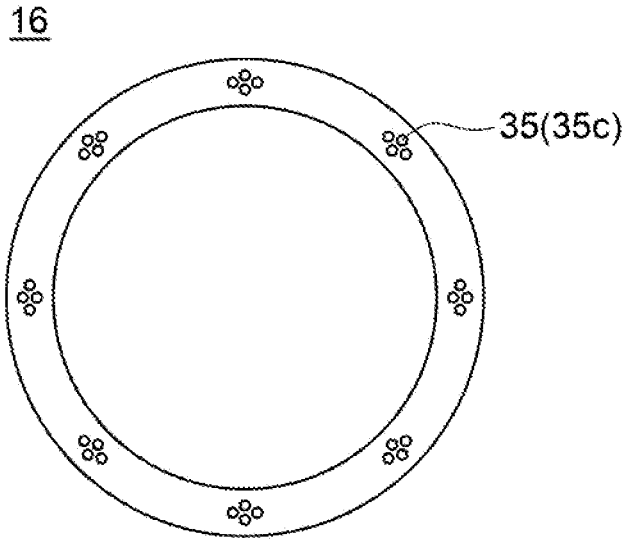

Further, the first opening 35 is not limited to the above described cut-out 35*a*. For instance, as depicted in FIG. 8A, the first opening 35 may further include a plurality of through holes 35*b* disposed at intervals in the circumferential direction of the flame holding ring 16. Furthermore, the present invention is not limited to the embodiment where the individual through holes 35*b* are disposed at intervals in the circumferential direction of the flame holding ring 16. As depicted in FIG. 8B), groups of through holes 35*c* having the same or different diameters may be disposed at intervals in the circumferential direction of the flame holding ring 16.

As depicted in FIGS. 2 and 4, at the upstream side of the flame holding ring 16, between the first nozzle cylinders 3 and the second nozzle cylinder 12, the upstream-side wall portion 54 is disposed so as to extend in the circumferential direction of the combustor 50 and outward in the radial direction. The upstream-side wall portion 54 connects the upstream end of the outlet portions 20 or the downstream end of the first nozzle cylinders 3 to the upstream end of the pilot cone 15 or the downstream end of the second nozzle cylinder 12. The air inlets 30 are formed on the upstream-side wall portion 54 such that a part of compressed air 'a' sent from the compressor 102 (see FIG. 1) flows through the air inlets 30. The compressed air 'a' having passed through the air inlets 30 is supplied toward the flame holding ring 16 via the annular space 29 at the radially inner side of the outlet portions 20.

The flame holding ring 16 forms a low flow-velocity region where the flow velocity is low, at the downstream side thereof, and thereby the flame holding performance is improved. However, as depicted in FIGS. 3 and 5, the flame holding ring 16 has the first openings 35 formed thereon, such that the first openings 35 have intervals between one another in the circumferential direction of the flame holding ring 16. A large amount of compressed air which is not mixed with fuel is supplied from the portion where the first openings 35 are formed. Thus, the flame holding performance is low, or the flame is not held at all, which impairs the flame holding effect. Accordingly, the flame holding effect of the flame holding ring 16 has an uneven distribution in the circumferential direction. At the portion where flame holding is impaired, combustion occurs at the downstream side of the flame holding ring 16, due to the flame around the portion.

Generally, mixing of the pre-mixed gas is less sufficient at the upstream side, and when combustion occurs at a site where mixing of the pre-mixed gas is insufficient, combustion with a locally high flame temperature occurs, which leads to an increase in the generation amount of NOx. However, with the first openings 35 disposed at intervals in the circumferential direction of the flame holding ring 16, flame holding is impaired at the portion where the first openings 35 are provided and combustion occurs downstream of the flame holding ring 16. Thus, at the portion where the first openings 35 are provided, it is possible to suppress combustion at the upstream side where pre-mixing is not sufficient, and suppress an increase in the generation amount of NOx due to the local flame temperature rise. On the other hand, at the portion without the first openings 35, flame holding is not impaired and combustion occurs near the flame holding ring 16, which enables stable combustion. This stable combustion portion holds the flame at the portion with the first openings 35.

The cut-out 35*a* serving as the first opening 35 is disposed on the downstream-side end of the partition wall 24 in the circumferential direction of the flame holding ring 16, and has a greater width than the downstream-side end portion of the partition wall 24. With the above configuration, flame holding is impaired in the region downstream of the downstream-side end portion of the partition wall 24. In the region downstream of the downstream-side end portion of the partition wall 24, the mixing state of the pre-mixed gas is relatively insufficient compared to in the region downstream the gap between a pair of adjacent partition walls 24, 24. Thus, flame is held in the region downstream of the downstream-side end portion of the partition wall 24, and when combustion occurs at the upstream side, the generation amount of NOx is likely to increase due to the local flame temperature rise described above. Thus, by impairing flame holding in the region downstream the downstream-side end portion of the partition wall 24, it is possible to suppress an increase in the generation amount of NOx.

Furthermore, with regard to the cut-out depth of the cut-out 35*a* in the radial direction of the flame holding ring 16, the depth is smaller at the opposite end portions of the cut-out 35*a* in the circumferential direction of the flame holding ring 16 than at the center portion of the cut-out 35*a* in the circumferential direction of the flame holding ring 16. Preferably, the cut-out 35*a* has the maximum cut-out depth at the circumferential-directional position of the downstream-side end portion of the partition wall 24. With the above configuration, the flame holding performance decreases from the opposite end portions toward the center portion of the cut-out 35*a* with respect to the circumferential direction of the flame holding ring 16. Thus, by impairing flame holding reliably in the region downstream the circumferential-directional position corresponding to the partition wall 24, it is possible to suppress an increase in the generation amount of NOx.

The cut-out 35*a* is disposed at the radially outer side of the inner peripheral edge 16*a* of the flame holding ring 16, that is, on the outer peripheral edge portion. The cut-out 35*a* has a smaller opening area than a cut-out which is cut out from the outer peripheral edge 16*b* to the inner peripheral edge 16*a* of the flame holding ring 16, and thus it is possible to suppress the flow rate of compressed air flowing through the cut-out 35*a*. If the air passing through the cut-out 35*a* has a high flow rate, the volume of compressed air used in combustion decreases, and the generation amount of NOx increases. By suppressing the flow rate of compressed air flowing through the cut-out 35*a*, it is possible to suppress an increase in the generation amount of NOx.

Figure 9:
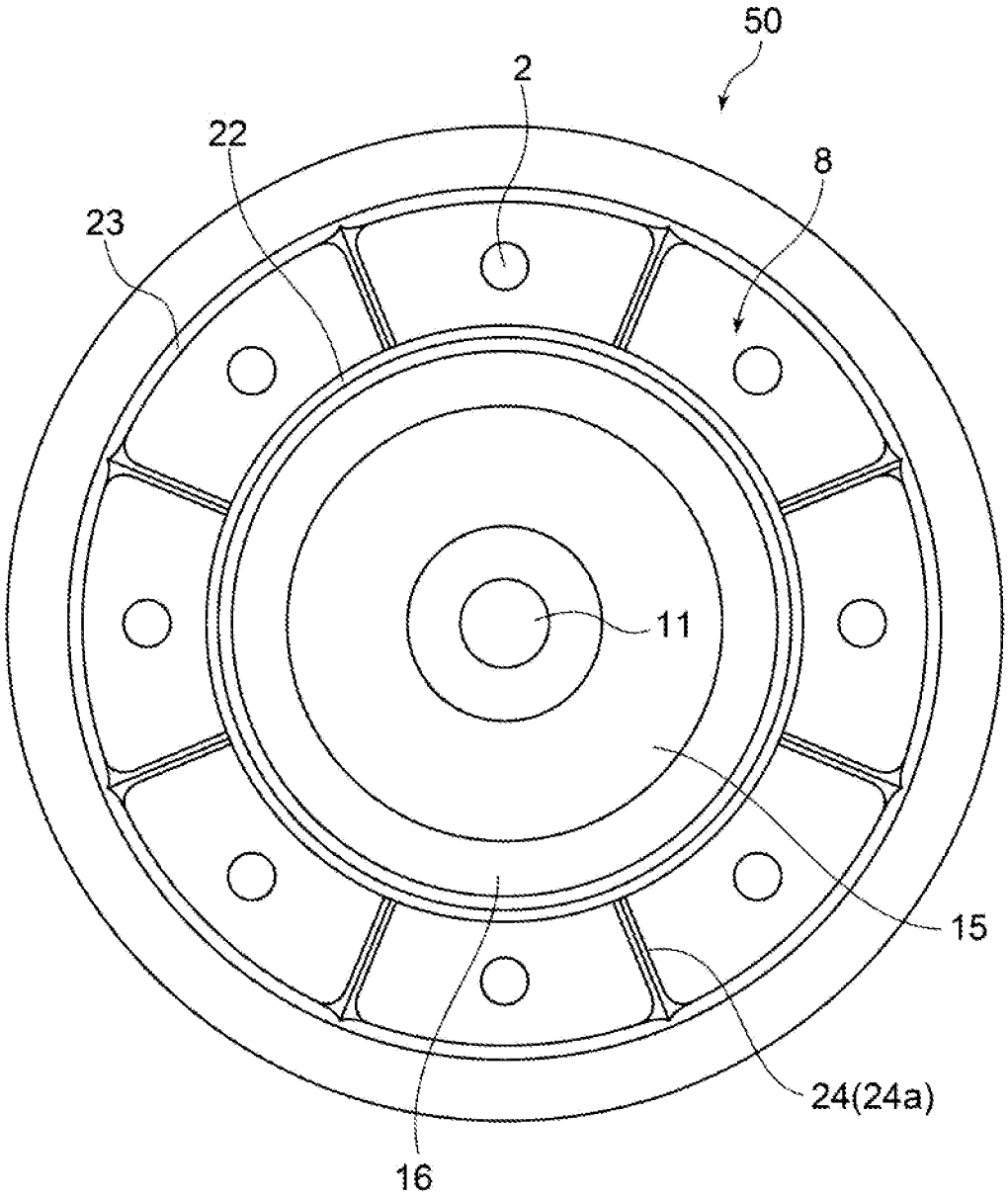
FIG. 9 is a front view of a combustor according to yet another embodiment.
Figure 10:
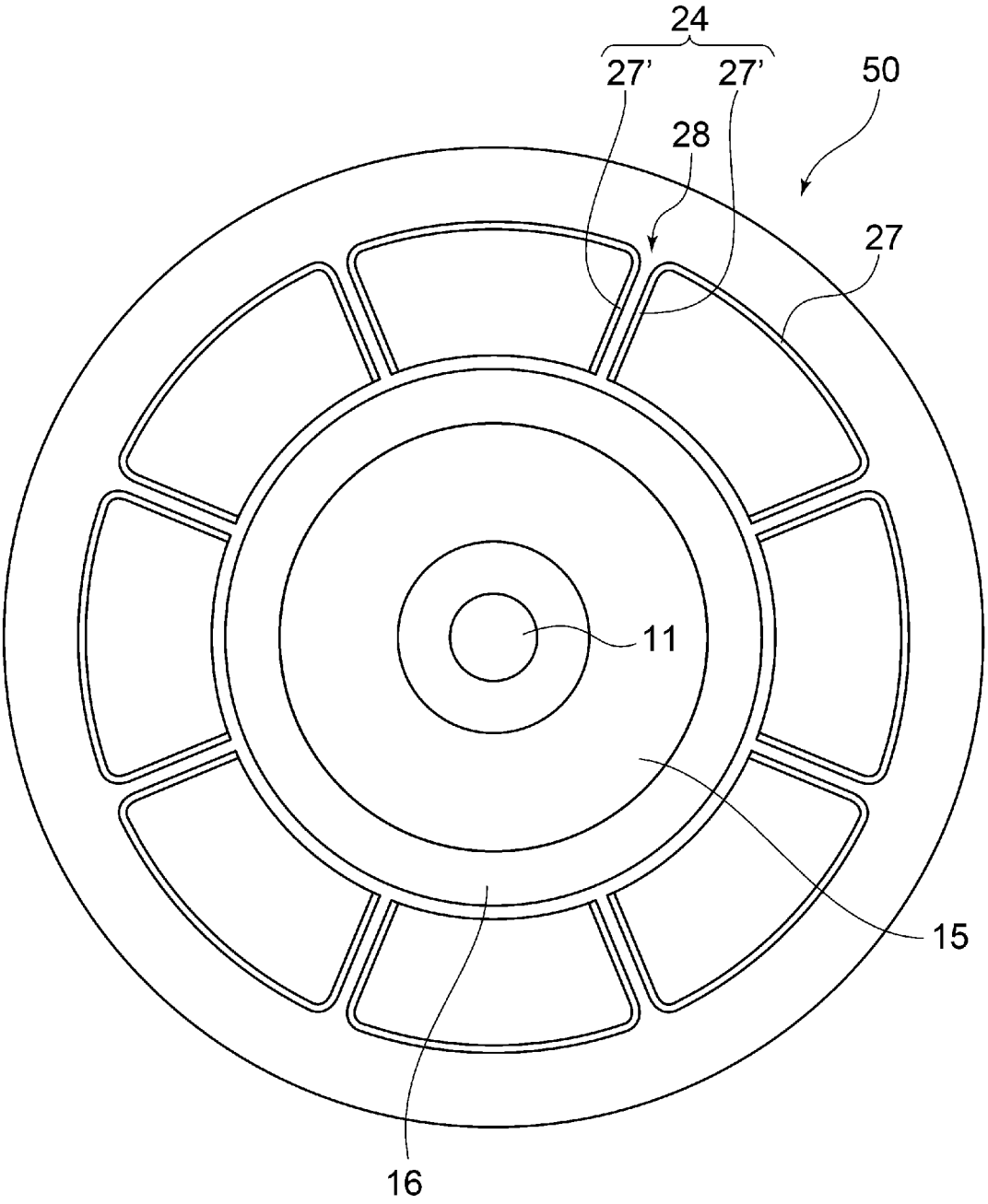
FIG. 10 is a front view of a combustor according to yet another embodiment.

In each of FIGS. 9 and 10, a combustor 50 according to yet another embodiment is depicted. The combustor 50 depicted in FIG. 9 has the same configuration as the combustor 50 depicted in FIGS. 2 and 3 except that the first opening 35 (see FIG. 3) are not formed on the flame holding ring 16, and that the configuration of the air inlets 30 (see FIG. 2) described below is different. The combustor 50 depicted in FIG. 10 has the same configuration as the combustor 50 depicted in FIGS. 4 and 5 except that the first openings 35 (see FIG. 5) are not formed on the flame holding ring 16, and that the configuration of the air inlets 30 (see FIG. 4) described below is different.

Next, with regard to the combustor 50 depicted in FIGS. 9 and 10, the configuration of the air inlets 30 will be described.

Figure 11:
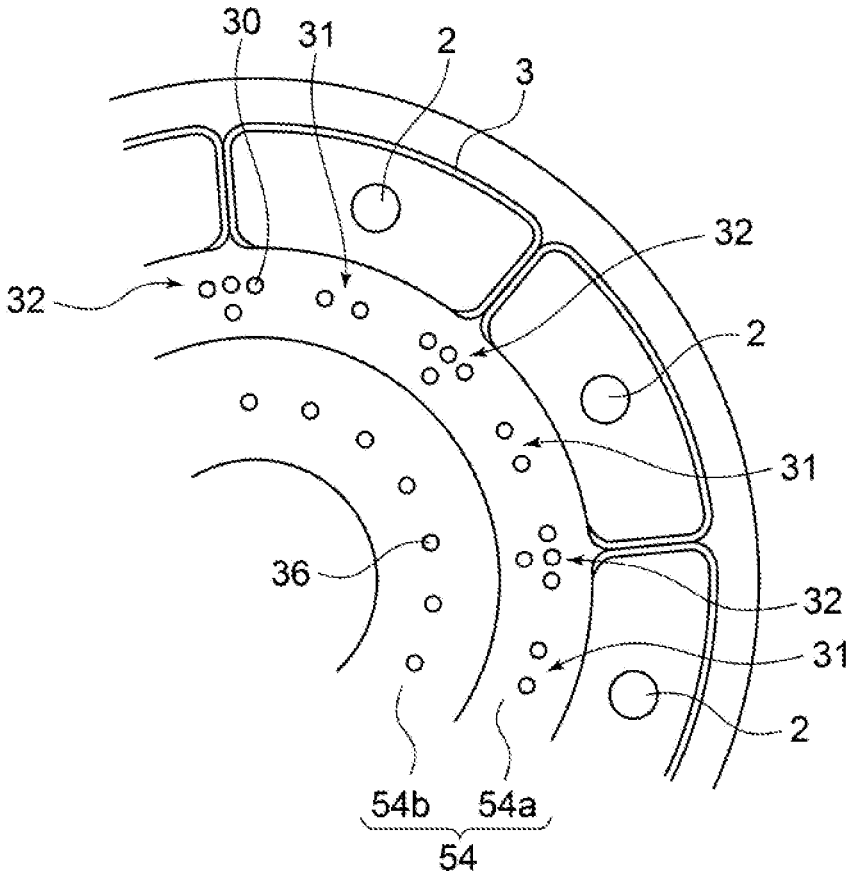
FIG. 11 is a partial planar view of an upstream-side wall portion of a combustor according to some embodiments.

As depicted in FIG. 11, the first portion 54*a* of the upstream-side wall portion 54 includes a first region 31 which is a region where the air inlets 30 are formed with a lower density, and a second region 32 which is positioned offset from the first region 31 in the circumferential direction and where the air inlets 30 are formed with a higher density than in the first region 31. The formation density of the air inlets 30 can be adjusted by increasing the number of air inlets 30 formed in the second region 32 compared to those in the first region 31, and/or increasing the size of the air inlets formed in the second region 32 compared to the size of the air inlets 30 formed in the first region 31.

A part of compressed air supplied from the compressor 102 (see FIG. 1) flows into the annular space 29 (see FIG. 1 or 3) through the first portion 54*a* of the upstream-side wall portion 54 via the air inlets 30, and flows toward the flame holding ring 16 (see FIGS. 9 and 10). The first region 31 and the second region 32 having different formation densities of the air inlets 30 are disposed in the circumferential direction of the first portion 54*a*, and thus the flow rate of air flowing toward the flame holding ring 16 has a distribution in the circumferential direction. Thus, while the flame is held in the low flow-velocity region downstream of the flame holding ring 16 in the circumferential-directional region corresponding to the first region 31, in the circumferential-directional region corresponding to the second region 32, flame holding is impaired by a relatively high flow rate of compressed air supplied from the upstream-side wall portion 54, and thereby the flame holding effect of the flame holding ring 16 becomes uneven in the circumferential direction. At the portion where flame holding is impaired, combustion occurs due to the flame around the portion at the downstream side of the flame holding ring 16.

Generally, mixing of the pre-mixed gas is less sufficient at the upstream side, and when combustion occurs at a site where mixing of the pre-mixed gas is insufficient, combustion with a locally high flame temperature occurs, which leads to an increase in the generation amount of NOx. However, with the formation density of the air inlets 30 being different in the first region 31 and the second region 32 in the circumferential direction of the first portion 54*a* of the upstream-side wall portion 54, flame holding is impaired in the circumferential-directional region corresponding to the second region 32 where a higher flow rate of compressed air flows compared to the first region 31, and combustion occurs at the downstream side of the flame holding ring 16. Thus, in the circumferential-directional region corresponding to the second region 32, it is possible to suppress combustion at the upstream side where pre-mixing is not sufficient, and suppress an increase in the generation amount of NOx due to the local flame temperature rise.

Furthermore, also for the combustor 50 according to the embodiments depicted in FIGS. 2 and 3, and 4 and 5, the first region 31 and the second region 32 may be provided in the circumferential direction of the first portion 54*a* of the upstream-side wall portion 54, with the formation density of the air inlets 30 being different. In the above embodiments, the region upstream of a portion of the flame holding ring 16 where the first openings 35 are formed serves as the second region 32 (see FIG. 11). With such a positional relationship between the first openings 35 and the second region 32, a relatively high flow rate of air is guided toward the downstream side of the flame holding ring 16 from the second region 32 of the first portion 54*a*. Thus, in the circumferential-directional region where the first openings 35 of the flame holding ring 16 are disposed, it is possible to impair flame holding by the flame holding ring 16 effectively, and obtain an uneven distribution for the flame holding effect of the flame holding ring 16 in the circumferential direction easily. Thus, it is possible to suppress combustion at the upstream side where pre-mixing is insufficient even further, and suppress an increase in the generation amount of NOx due to the local flame temperature rise effectively.

As depicted in FIG. 11, preferably, the extension range of the first region 31 in the circumferential direction is the circumferential-directional position corresponding to the position of the first nozzle 2, and the extension range of the second region in the circumferential direction is the circumferential-directional position between a pair of first nozzles 2, 2 that are adjacent in the circumferential direction. In this case, the flow rate of compressed air supplied via the air inlet 30 from the circumferential-directional position between the first nozzles 2,2 is higher than the flow rate of compressed air supplied via the air inlet 30 from the circumferential-directional position corresponding to the position of the first nozzle 2, and flame holding is impaired downstream of the circumferential-directional position between the first nozzles 2, 2. In the region downstream of the gap between the first nozzles 2, 2, the mixing state of the pre-mixed gas is relatively insufficient compared to in the region downstream of the first nozzle 2. Thus, when flame is held in the former region, the generation amount of NOx is likely to increase due to the local flame temperature rise described above. Thus, by impairing flame holding in the former region, it is possible to suppress an increase in the generation amount of NOx.

Figure 12:
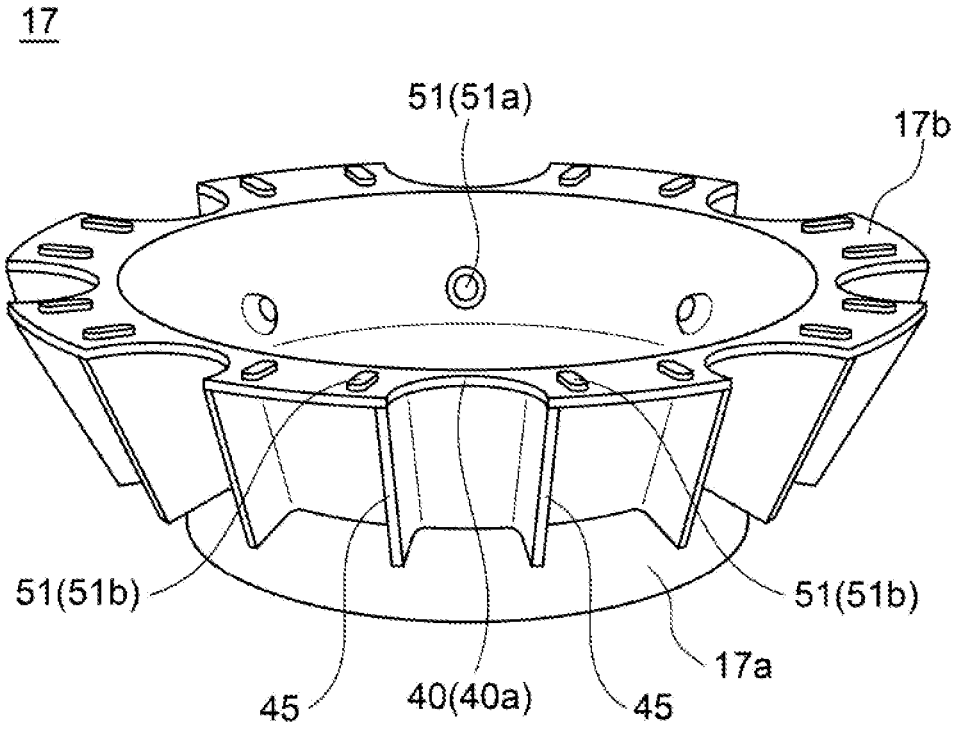
FIG. 12 is a perspective view of a cooling ring disposed on a combustor according to some embodiments.

In the embodiments depicted in FIGS. 2 and 3, 4 and 5, and 9 and 10, the combustor 50 may include a cooling ring 17 inside the annular space 29 extending in the circumferential direction at the radially inner side of the outlet portions 20 and at the radially outer side of the pilot cone 15. The cooling ring 17 is disposed adjoining to the upstream-side wall portion 54 at the radially outer side of the pilot cone 15, and at the radially inner side of the outlet portions 20. As depicted in FIG. 12, the cooling ring 17 includes a tubular body portion 17*a* extending such that the diameter increases from one end to the other end, and a flange portion 17*b* disposed so as to extend in the circumferential direction along the end portion of the tubular body portion 17*a* that has a greater outer diameter. The tubular body portion 17*a* may at least partially extend parallel to the pilot cone 15, and the flange portion 17*b* may at least partially extend parallel to the flame holding ring 16. The flange portion 17*b* extends outward in the radial direction of the tubular body portion 17*a* from the end portion of the tubular body portion 17*a*. On the flange portion 17*b*, a second opening 40 is formed at a position corresponding to the first opening 35 (see FIGS. 3 and 5) formed on the flange portion 17*b*, when the cooling ring 17 is disposed inside the annular space 29 (see FIGS. 2 and 4). In other words, the first opening 35 and the second opening 40 overlap as seen in the axial direction at a region of half or more, or preferably, at a region of 90% or more. The second opening 40 preferably has the same shape as the first opening 35, and a cut-out 40*a* having the same shape as the cut-out 35*a* is formed on the cooling ring 17 in FIG. 12. Accordingly, the cut-out 35*a* and the cut-out 40*a* overlap, whereby it is possible to impair flame holding with the overlapping portion.

Furthermore, the cooling ring 17 may include a spacer portion 51 for forming a gap 56 between the pilot cone 15 and the flame holding ring 16 (see FIGS. 2 and 4). The spacer portion 51 may include a plurality of protruding portions 51*a* disposed so as to protrude from the inner surface of the tubular body portion 17*a*, and/or a plurality of protruding portions 51*b* positioned at either side of the cut-out 40*a* with respect to the circumferential direction of the flange portion 17*b* and disposed so as to protrude from the surface of the flange portion 17*b*. When the cooling ring 17 is disposed inside the annular space 29 (see FIG. 1 or 3), the protruding portions 51*a* protrude toward the pilot cone 15 (see FIG. 1 or 3), and the protruding portions 51*b* protrude toward the flame holding ring 16 (see FIG. 1 or 3). Accordingly, as depicted in FIGS. 2 and 4, it is possible to form the gap 56 between the pilot cone 15 and the tubular body portion 17*a*, and between the flame holding ring 16 and the flange portion 17*b*. In particular, with the protruding portions 51*b* being positioned on either side of the cut-out 40*a* with respect to the circumferential direction of the flange portion 17*b*, it is possible to form the gap 56 to be uniform in the circumferential direction, between the flame holding ring 16 and the flange portion 17*b*. Each protruding portion 51*a* is disposed at a circumferential-directional position between a pair of protruding portions 51*b* that are adjacent in the circumferential direction. Further, the gap 56 is narrower than the space between the cooling ring 17 and the outlet portions 20.

As depicted in FIGS. 2 and 4, the upstream-side wall portion 54 disposed upstream of the flame holding ring 16 includes the first portion 54*a* having a plate shape supporting the first nozzle cylinders 3 and extending inward in the circumferential direction from the outer side of the first nozzle cylinders 3, and the second portion 54*b* having a truncated cone shape supporting the second nozzle cylinder 12 and extending outward in the circumferential direction from the outer side of the second nozzle cylinder 12, the second portion 54*b* extending in a different direction from the first portion 54*a*. With regard to the radial direction of the upstream-side wall portion 54, the portion at the outer side of the cooling ring 17 may be the first portion 54*a*, and the portion at the inner side of the cooling ring 17 may be the second portion 54*b*. The air inlets 30 are formed on the first portion 54*a*, and a cooling air inlet 36 opening into the gap 56 between the pilot cone 15 and the cooling ring 17 is formed on the second portion 54*b*.

A part of compressed air supplied from the compressor 102 (see FIG. 1) passes through the second portion 54*b* of the upstream-side wall portion 54 via the cooling air inlet 36, besides the air inlets 30, flows into the gap 56 between the pilot cone 15 and the cooling ring 17, flows through the gap 56 between the flame holding ring 16 and the flange portion 17*b*, and is discharged to the combustion chamber 55 from the outlet portions 20. During this course of flowing, the pilot cone 15 and the flame holding ring 16 are cooled. If the gap 56 is uniform with the above configuration of the spacer portion 51, the air passes through the gap 56 at a uniform flow velocity, and thus it is possible to cool the pilot cone 15 and the flame holding ring 16 uniformly.

Figure 13:
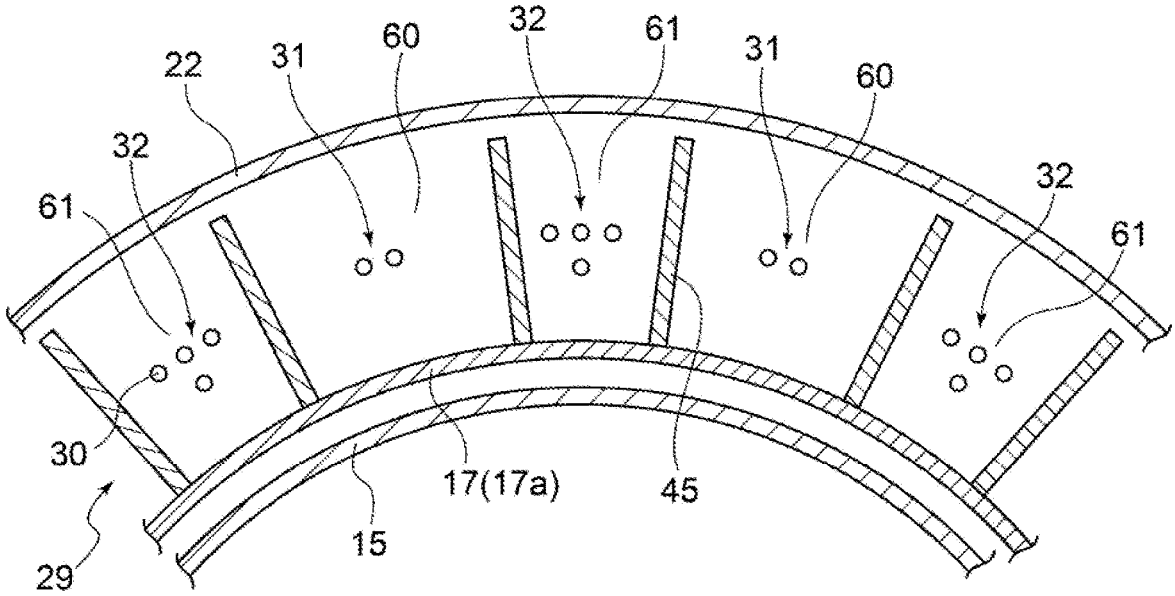
FIG. 13 is a cross-sectional view taken along line X-X in FIGS. 2 and 4.

As depicted in FIG. 13, a partition member 45 having a plate shape may divide the annular space 29 into the first space 60 corresponding to the first region 31 and the second space 61 corresponding to the second region 32. In this case, the first space 60 and the second space 61 are positioned alternately in the circumferential direction. The partition member 45 may extend, as depicted in FIG. 12 for instance, along the axial direction of the tubular body portion 17*a* of the cooling ring 17, on the outer surface of the tubular body portion 17*a*. In this case, the partition member 45 is disposed so as to be positioned on either side of the cut-out 40*a* with respect to the circumferential direction of the flange portion 17*b*, at the upstream side of the flange portion 17*b*. In an embodiment where the cooling ring 17 has the partition member 45, as depicted in FIGS. 2 and 4, the partition member 45 is adjoining to the upstream-side wall portion 54, and a small gap is formed between the partition member 45 and the upstream-side wall portion 54. Furthermore, the partition member 45 may not necessarily be disposed on the cooling ring 17, and may be disposed on the inner ring 22 (see FIG. 13). Alternatively, some partition members 45 may be disposed on the inner ring 22, and other partition members 45 may be disposed on the cooling ring 17. Furthermore, in a case where the cooling ring 17 is not provided, the partition member 45 may be disposed on one of, or both of, the inner ring 22 and the pilot cone 15. Furthermore, the partition member 45 may be disposed so as to extend downstream from the first portion 54*a* of the upstream-side wall portion 54.

Since the annular space 29 is divided into the first space 60 and the second space 61 by the partition member 45, the partition member 45 suppresses a decrease of the air amount inside the second space 61 by preventing the air from flowing into the first space 60 from the second space 61. Accordingly, the distribution of the air flow rate in the circumferential direction is maintained, and thereby it is possible to maintain the flame holding effect of the flame holding ring to be uneven in the circumferential direction.

As described above, according to at least some embodiments of the present invention, the flame holding effect of the flame holding ring 16 is uneven in the circumferential direction, and thus it is possible to suppress combustion at the upstream side where pre-mixing is insufficient in at least a partial region in the circumferential direction while holding flame, and suppress an increase in the generation amount of NOx due to the local flame temperature rise while holding the flame.

In the above described embodiments, the flame holding ring 16 may extend so as to form an angle with the longitudinal direction of the first nozzles 2 toward the outer side in the radial direction of the combustor 50 from the downstream end of the pilot cone 15. This description includes an embodiment where the flame holding ring 16 extends toward the outer side in the radial direction of the combustor 50 from the downstream end of the pilot cone 15 such that the angle formed between the flame holding ring 16 and the longitudinal direction of the first nozzles 2 is the same as the angle formed between the pilot cone 15 and the longitudinal direction of the first nozzles 2. In this case, the portion extending in the circumferential direction of the combustor 50 at the radially inner side of the outlet portions 20 of the plurality of first nozzles 2 corresponds to the flame holding ring 16, and the upstream side of the flame holding ring 16 corresponds to the pilot cone 15.

In the above described embodiments, the flange portion 17*b* extends toward the outer side in the radial direction of the tubular body portion 17*a* from the other end of the tubular body portion 17*a* that extends such that the diameter increases from one end toward the other end. This description includes an embodiment where the tubular body portion 17*a* and the flange portion 17*b* both extend in the same direction such that the diameter increases from one end to the other end, that is, the tubular body portion 17*a* and the flange portion 17*b* form a single truncated cone shape as a whole. In this case, the upstream side of the flame holding ring 16, that is, the region overlapping with the flame holding ring 16 in the axial direction corresponds to the flange portion 17*b*, and the upstream side of the flange portion 17*b* corresponds to the tubular body portion 17*a*.

In the above described embodiments, the first portion 54*a* is a plate-shaped member extending inward in the circumferential direction from the outer side of the first nozzle cylinders 3, and the second portion 54*b* is a truncated cone shape member extending outward in the circumferential direction from the outer side of the second nozzle cylinder 12 but in a different extension direction from the first portion 54*a*. Nevertheless, this embodiment is not limitative. The extension direction of the first portion 54*a* may be the same as the extension direction of the second portion 54*b*. That is, the first portion 54*a* and the second portion 54*b* may form a single plate-shaped member, or form a single truncated cone shape, between the first nozzle cylinder 3 and the second nozzle cylinder 12.

In the above described embodiments, the combustor 50 includes the second nozzle 11. Nevertheless, the combustor may not necessarily include the second nozzle 11 and may include only the plurality of first nozzles 2, and a gas turbine may include such a combustor.

In the above described embodiments, the combustor 50 is applied to the gas turbine 100, but application of the combustor 50 is not limited to the gas turbine 100.

REFERENCE SIGN LIST

2 First nozzle (nozzle)
15 Pilot cone
16 Flame holding ring
16*a* Inner peripheral edge
16*b* Outer peripheral edge
17 Cooling ring

17*b* Flange portion
20 Outlet portion
24 Partition wall
29 Annular space
30 Air inlet
31 First region
32 Second region
35 First opening
35*a* Cut-out
35*b* Through hole
35*c* Through hole
36 Cooling air inlet
40 Second opening
40*a* Cut-out
45 Partition member
50 Combustor
51 Spacer portion
51*a* Protruding portion
51*b* Protruding portion
54 Upstream-side wall portion
56 Gap
60 First space
61 Second space
100 Gas turbine
106 Turbine

The invention claimed is:

1. A combustor, comprising:

a plurality of fuel nozzles disposed in a circumferential direction;

a flame holding ring extending in the circumferential direction at a radially inner side of outlet portions of the plurality of fuel nozzles;

an upstream-side wall portion extending in the circumferential direction at an upstream side of the flame holding ring, the upstream-side wall portion having a plurality of air inlets for supplying air toward the flame holding ring via an annular space at the radially inner side of the outlet portions of the plurality of fuel nozzles, wherein the upstream-side wall portion includes:

a plurality of first regions each having a first number of the plurality of air inlets, wherein each of the plurality of first regions extends circumferentially in a respective first range corresponding to a respective fuel nozzle position of each of the plurality of fuel nozzles; and a plurality of second regions each having a second number of the plurality of air inlets with the second number higher than the first number;

wherein each of the plurality of second regions extends circumferentially in a respective second range corresponding to a respective circumferential position between a respective pair of adjacent fuel nozzles of the plurality of fuel nozzles such that each of the plurality of second regions alternates with each of the plurality of first regions in the circumferential direction, and in which the second number of the plurality of air inlets are formed at a higher density than a density of the first number of the plurality of air inlets, and wherein a first spacing in the circumferential direction between each air inlet of the second number within a respective second region is smaller than a second spacing in the circumferential direction between any air inlet of the second number within the respective second region and any air inlet of the first number within an adjacent first region.

2. The combustor according to claim 1, wherein the flame holding ring includes a first opening positioned at a downstream side of each of the second regions.

3. The combustor according to claim 2, wherein the first opening includes at least one cut-out which is cut out from an outer peripheral edge of the flame holding ring to a position radially outward of an inner peripheral edge of the flame holding ring, toward an inner side of the flame holding ring in a radial direction.

4. The combustor according to claim 3, wherein the cut-out has a maximum cut-out depth which is not greater than ⅔ of a distance between the outer peripheral edge and the inner peripheral edge in the radial direction of the flame holding ring.

5. The combustor according to claim 2, wherein the first opening includes at least one through hole formed between an outer peripheral edge of the flame holding ring and an inner peripheral edge of the flame holding ring.

6. The combustor according to claim 1, further comprising:

a plurality of partition members each extending along an axial direction in the annular space between the upstream-side wall portion and the flame holding ring, each of the plurality of partition members dividing the annular space circumferentially into a plurality of first spaces each corresponding to a respective first region of the plurality of first regions and a plurality of second spaces each corresponding to a respective second region of the plurality of the second regions, wherein each of the plurality of first spaces alternates with each of the plurality of second spaces in the circumferential direction.

7. The combustor according to claim 1, further comprising:

a pilot cone having the flame holding ring at a downstream end; and a cooling ring disposed at a radially outer side of the pilot cone and at the radially inner side of the outlet portions of the plurality of fuel nozzles, wherein a gap is formed between the pilot cone and the cooling ring.

8. The combustor according to claim 7, wherein the flame holding ring includes a plurality of first openings with each first opening of the plurality of first openings positioned at a respective downstream side of a respective second region of the plurality of second regions, and wherein the plurality of air inlets of the upstream-side wall portion and the plurality of first openings of the flame holding ring are in communication via a space at a radially outer side of the cooling ring and at the radially inner side of the outlet portions of the plurality of fuel nozzles.

9. The combustor according to claim 7, wherein the upstream-side wall portion has a cooling air inlet which opens into the gap between the pilot cone and the cooling ring.

10. The combustor according to claim 7, wherein the flame holding ring positioned at the downstream end of the pilot cone includes a plurality of first openings with each first opening of the plurality of first openings positioned at a respective downstream side of a respective second region of the plurality of second regions, wherein the cooling ring includes a flange portion positioned at an upstream side of the flame holding ring, and wherein the flange portion includes a plurality of second openings with each second opening of the plurality of second openings positioned at a respective upstream side of a respective first opening of the plurality of first openings of the flame holding ring.

11. The combustor according to claim 7, further comprising:

at least one spacer portion for forming the gap between the pilot cone and the cooling ring.

12. The combustor according to claim 11, wherein the cooling ring includes a flange portion positioned at an upstream side of the flame holding ring, wherein the flange portion has a second opening corresponding to a first opening of the flame holding ring, wherein the at least one spacer portion includes a plurality of protruding portions disposed on the flange portion so as to protrude downstream toward the flame holding ring, and wherein the plurality of protruding portions include a pair of protruding portions positioned at either side of the second opening of the flange portion in the circumferential direction.

13. A gas turbine, comprising:

the combustor according to claim 1; and a turbine configured to be driven by combustion gas from the combustor.

* * * * *